United States Patent [19]

Carns

[11] 4,194,777

[45] Mar. 25, 1980

[54] DOG WASTE SCOOP

[76] Inventor: Arthur Carns, 120-47 - 217th St., Cambria Heights, N.Y. 11411

[21] Appl. No.: 956,207

[22] Filed: Oct. 30, 1978

[51] Int. Cl.[2] ..... A01K 29/00

[52] U.S. Cl. ..... 294/1 BA; 294/115

[58] Field of Search ..... 294/1 R, 11, 19 R, 22, 294/50.8, 50.9, 55, 115; 15/104.8, 257.1, 257.6, 257.7; 119/1

[56] References Cited

U.S. PATENT DOCUMENTS

| | | | |
|---|---|---|---|
| 1,277,778 | 9/1918 | Tichacek | 294/22 |
| 3,139,299 | 6/1964 | Bowen | 294/115 X |
| 3,446,525 | 5/1969 | Jones | 294/115 X |
| 3,606,436 | 9/1971 | Lynch | 294/19 R |
| 3,738,697 | 6/1973 | Kahan | 294/115 X |
| 3,841,686 | 10/1974 | Gallo et al. | 294/19 R |

*Primary Examiner*—Johnny D. Cherry
*Attorney, Agent, or Firm*—Richard L. Miller

[57] ABSTRACT

An implement for picking up dog feces in an agreeable manner; the device including a long handle which at one end has two pivoted scoop-shaped jaws so to form a mouth therebetween, each jaw having an adhesive pad for holding a cellophone sheet across the mouth and around the jaw lips for receiving the feces without contaminating the implement, and a pull rod through the handle for conveniently spreading the jaws apart.

3 Claims, 4 Drawing Figures

10
11
12
13
14
15
16
17
18
19
20
21
22
23
24
25
26
27
28

DOG WASTE SCOOP

BACKGROUND OF THE INVENTION

This invention relates generally to household pets accessories. More specifically it relates to implements of picking up pet feces.

It is well known that picking up feces of a dog or cat is a disagreeable chore. The odor is unpleasant and there is always the danger of accidently touching the same. Now that many municipalities such as New York City have a law requiring a pet owner to pick up feces left by a dog or other pet on a sidewalk, many more persons are now confronted with this clean up chore. Many persons have tried to get rid of their pets so as to avoid doing it. Others simply try to pick it up by a newspaper in hand trusting to not be contaminated by a contact therewith. This situation accordingly is in want of an improvement.

SUMMARY OF THE INVENTION

Therefore it is a principal object of the present invention to provide an implement for picking up feces agreeably so a person will not touch the same, and which eliminates need to bend down close to the feces and smelling it.

Another object is to provide a dog waste scoop which itself does not touch the feces so that it cannot become contaminated.

Still another object is to provide a dog waste scoop which can be conveniently carried by a pet walker while walking a dog on a city sidewalk.

Still another object is to provide a dog waste scoop which can also be used inside a home in case a pet accidently vomits or has a bowel movement upon a floor or carpet.

Still a further object is to provide a dog waste scoop which allows transporting the feces in a covered up manner to a place of disposal.

Further objects of the invention will appear as the description proceeds.

To the accomplishment of the above and related objects, this invention may be embodied in the form illustrated in the accompanying drawing, attention being called to the fact, however, that the drawings are illustrative only, and that changes may be made in the specific construction illustrated and described within the scope of the appended claims.

DESCRIPTION OF THE PREFERRED EMBODIMENTS

Figures 1, 2, 3, 4:
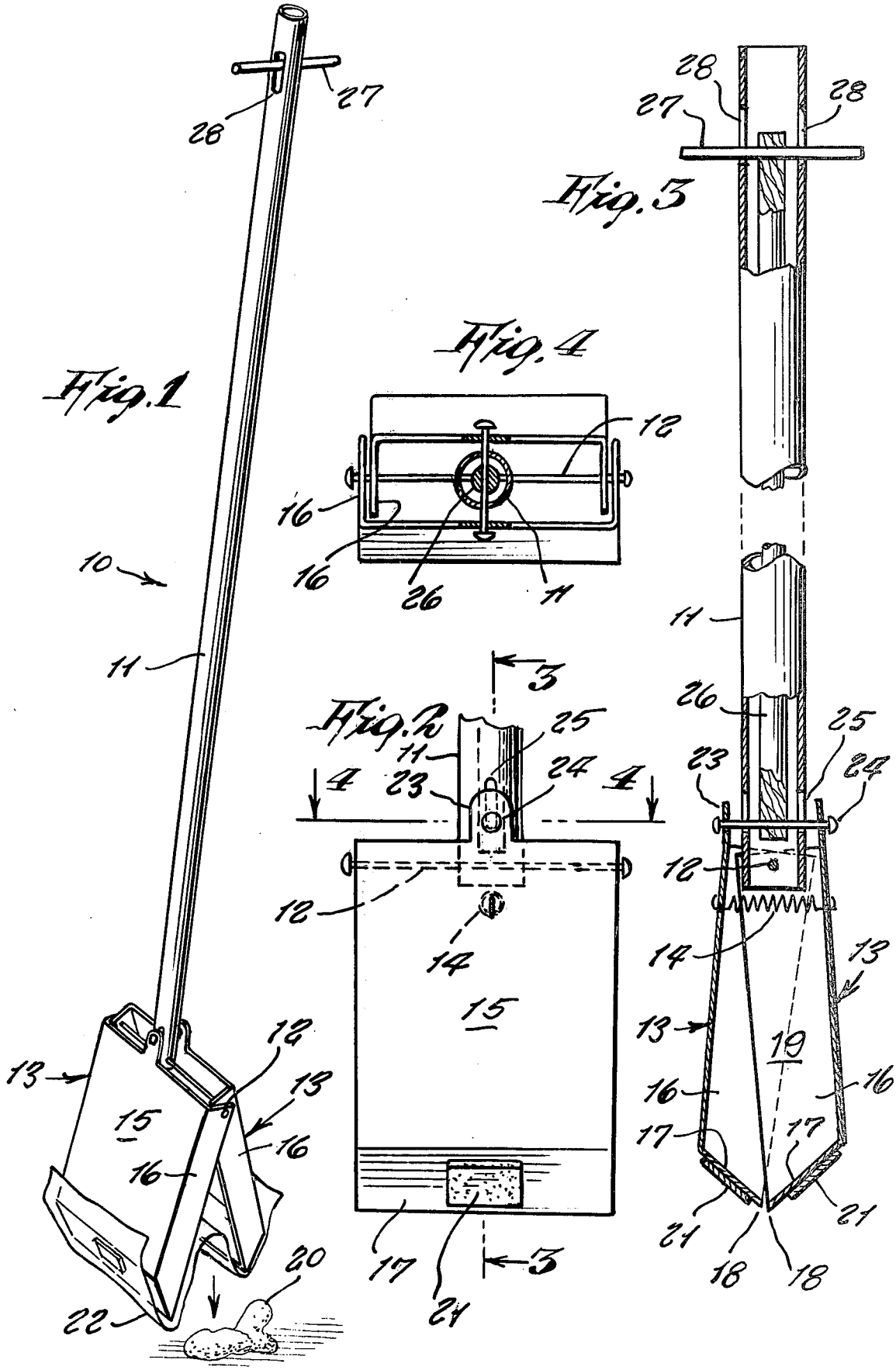
FIG. 1 is a perspective view of the invention, shown with jaws partly opened so to pick up an animal defecation.
FIG. 2 is an enlarged front view detail thereof.
FIG. 3 is a cross sectional view on line 3—3 of FIG. 2.
FIG. 4 is a cross sectional view on line 4—4 FIG. 2.

Referring now to the drawing in greater detail, the reference numerical 10 represents a dog waste scoop according to the present invention wherein there is a long tubular handle 11 which at one end has a transverse extending rivet 12 therethrough and on which two scoop-shaped jaws 13 pivot so to open or close a mouth formed therebetween. A tension coil spring 14 therebetween normally retains the jaws in a closed position.

Each jaw includes a back wall 15 and opposite side flanges 16 at right angle thereto and through which the the rivet 12 extends. Each jaw also includes an angularly tapering lip 17 on its end so that when the mating edges 18 of the lips are brought together, the jaws together enclose a central chamber 19 in which feces 20 may be carried. A pad 21 on an outer side of each lip may be comprised either of wax, or a member having pressure sensitive adhesive on both sides so that an outside surface thereof will firmly hold a removable and replaceable sheet 22 of cellophane or polyethylene stretched across the open mouth and around the outer sides of the lips, as shown in FIG. 1 so to protect the implement from contact with the feces when being lowered thereover.

An upward tongue 23 along an upper edge of each jaw has a single rivet 24 extending therethrough and transversely through vertical slot 25 in opposite sides of the handle. The rivet also extends transversely through a hole in a lower end of a pull rod 26 contained inside the handle, the upper end of the pull rod extends nearly to the upper end of the handle, where a transverse extending peg 27, through a hole in the pull rod, also extends through vertical dots 28 on opposite sides of the handle.

In operative use, a cellophane sheet 22 is fitted across the mouth and secured to the pads 21, it being understood that the sheet is wider than the jaws so as to protect the side flanges 16 from feces contact. The handle peg 27 is then upwardly lifted so to pivot the jaws apart.

The device is positioned over a feces and lowered. The handle peg is released so the jaws clamp around the feces moving it up into the cellophane lined chamber 19. The device can now serve to carry the picked up feces to a refuse can or other place of disposal. The cellophane sheet is discarded as feces.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A dog waste scoop, comprising in combination, an elongated tubular handle, a pair of scoop-shaped jaws pivotally attached at one end of said handle, a tension coil spring normally urging said jaws in a pivotally closed position, and a pull rod slidable in the center of said handle having a hand-operated cross-peg near an upper end of said handle for convenient pulling so as to pivot said jaws apart; a lower end of said pull rod having a transverse rivet connected to upward tongues on an upper edge of each said jaw; each said jaw including an inclined lip at its lower end so that a lower edge of said lips abut each other when said jaws are closed, an adhesive pad mounted on an outer side of each said lip, so that a disposable cellophane sheet maybe temporarily adhered at its opposite ends to said pads while a center of said sheet bridges across an entry to a mouth formed between said jaws, said sheet center extending inwardly inside said mouth.

2. The combination as set forth in claim 1, wherein said pad comprises a pressure sensitive adhesive.

3. The combination as set forth in claim 1, wherein said pad comprises wax.

* * * * *